United States Patent [19]

Harry

[11] Patent Number: 4,746,234

[45] Date of Patent: May 24, 1988

[54] RELATING TO POSTAL FRANKING MACHINES

[75] Inventor: Alan Harry, Royston, England

[73] Assignee: Francotyp-Postalia GmbH, Fed. Rep. of Germany

[21] Appl. No.: 826,557

[22] Filed: Feb. 6, 1986

Related U.S. Application Data

[63] Continuation-in-part of Ser. No. 631,211, Jul. 16, 1984, abandoned.

[30] Foreign Application Priority Data

Jul. 23, 1983 [GB] United Kingdom ..... 8319921

[51] Int. Cl.[4] ..... B41J 3/20; B41J 11/20

[52] U.S. Cl. ..... 400/120; 101/91; 400/661.3

[58] Field of Search ..... 400/120, 661.3; 101/91

[56] References Cited

U.S. PATENT DOCUMENTS

| | | | |
|---|---|---|---|
| 3,868,008 | 2/1975 | Brumbaugh | 400/661.3 |
| 3,920,113 | 11/1975 | Tamai | 101/376 |
| 3,963,340 | 6/1976 | Gerace | 400/83 |
| 3,977,533 | 8/1976 | Hills et al. | 400/120 |
| 4,023,184 | 5/1977 | Stillman, Jr. | 400/120 |
| 4,264,396 | 4/1981 | Stewart | 101/288 |
| 4,513,298 | 4/1985 | Schen | 346/140 PD |
| 4,580,144 | 4/1986 | Calvi | 400/120 |
| 4,581,616 | 4/1986 | Ross et al. | 400/120 |

FOREIGN PATENT DOCUMENTS

| | | | |
|---|---|---|---|
| 1800261 | 5/1970 | Fed. Rep. of Germany | 400/618 |
| 6407373 | 1/1965 | Netherlands | 400/661.3 |

OTHER PUBLICATIONS

Graham et al., "Thermal Printer Reinking Cartridge" IBM Tech Disclosure Bulletin, vol. 25, No. 11A, pp. 5814–5815, 4–83.

*Primary Examiner*—William Pieprz

*Attorney, Agent, or Firm*—Nelson E. Kimmelman; Louis Weinstein

[57] ABSTRACT

Postal franking apparatus in which both semi-permanent and variable information to be printed onto an envelope is stored electrically in a memory and is read out to form printing control signals for controlling a thermal printer containing thermally activable inking means at a printing station into which the envelope is placed. The thermal printer is in the form of an elongate conductive plate having a large plurality of electrical connections along its length to which are fed the printing control signals in synchronized relationship to passage of the envelope, the plate being of sufficiently high resistivity that only localized areas thereof are heated by the currents associated with the control signals, and ink is applied to the envelope only at the heated localities.

9 Claims, 5 Drawing Sheets

RELATING TO POSTAL FRANKING MACHINES

This is a continuation-in-part application of co-pending application Ser. No. 631,211 of Alan Harry filed July 6, 1984 bearing the same title and now abandoned.

DESCRIPTION

FIELD OF INVENTION

This invention concerns franking machines by which envelopes and the like can be overprinted to indicate postal prepayment and the date and town or city in which the envelope is to be posted. Such printing takes the form of information which is variable. The printing often also includes advertising or promotional material which may be in the form of words and or pictures or combinations thereof. This additional material constitutes information of a semi-permanent nature.

BACKGROUND TO THE INVENTION

Conventionally postal franking machines have included a printing cylinder which bears the semi-permanent information to be applied by overprinting to an envelope together with a plurality of selectable printing devices for printing variable insertions into the permanent information such as the date and the amount of the prepaid postage applicable. A relatively complex mechanism has consequently been needed to effect variation of the selectable printing devices which have had to be located within the cylinder.

Furthermore, any change in the semi-permanent information (for example to introduce current advertising material into the data to be printed on the envelope) has often necessitated major changes to the cylinder and the replacement of at least part of the latter with fresh sectors containing the new typeface.

It is an object of the present invention to provide an improved postal franking machine in which changes in the content of the printed material can be made more easily than hitherto.

A further difficulty associated with the franking of envelopes concerns the frequently very uneven thickness of the latter across the width of the region to which the printed matter is to be applied.

Accordingly it is a subsidiary feature of the invention to provide an improvement in the design of postal franking machines which will allow for such uneveness in envelopes to be printed.

SUMMARY OF THE INVENTION

According to the present invention postal franking apparatus is provided comprising:

(1) memory means in which semi-permanent and variable information to be printed onto an envelope is stored electrically;

(2) means for inputting information to the memory to change some or all of the information stored therein;

(3) means for reading out information from the memory to form printing control signals;

(4) a printing station into which an envelope to be franked can be placed;

(5) printing means; and (6) means for supplying the printing control signals to the printing means; wherein (7) both the semi-permanent and variable information is printed by thermal printing means which comprises an elongate conductive element having relatively high electrical resistivity, to which a plurality of electrical connections are made along its length, and the supplying means comprises means for applying electrical currents to selected ones of the connections for producing localised heating of the conductive element for causing ink at the heated localities to be deposited onto an envelope, thereby to frank the envelope with both the semi-permanent and variable information.

As used herein the expression envelope is intended to mean any packet or generally flat parcel or label for use thereon and may for example be a postal packet, envelope bag or container or label for attachment thereto and may be of paper or plastics or fabric or metal foil or any combination thereof.

The thermally activatible inking means may comprise a ribbon or like sheet member carrying or impregnated with ink and adapted to pass between the thermal printing head and the envelope. The ribbon may be pre-inked and after use discarded and replaced with a fresh ribbon or the ribbon may be an endless loop and an ink reservoir may be provided for transferring ink thereto.

Alternatively an offset process may be employed in which an inked impression of what is to be printed on the envelope is formed on a transfer device which passes through the printing station so as to leave the inked impression on an envelope located thereat. In this case an ink reservoir may be provided in the form of a porous roller loaded with thermally activated ink.

Thus where an offset mechanism is required, one preferred means for achieving this comprises:

(1) a length of ribbon material adapted to carry albeit temporarily, the inking medium, (2) means for loading inking medium onto the ribbon selectively from the reservoir, and (3) heating means for transferring ink from the inked regions of the ribbon onto an envelope.

A re-usable endless loop of ribbon material may be employed, in which case means are provided for removing any surplus ink from the ribbon after printing, before the relevant region of ribbon is returned to the loading means.

An alternative arrangement, which avoids the need for removing surplus ink, is to provide a length of intermediate ribbon which is used once only. Instead of an endless loop, a spool of initially inked ribbon is provided with used ribbon being fed to a take-up spool, to be thrown away when fully used.

An ink can be employed which will melt and form a liquid or will change its phase from a solid (or liquid) into a vapour phase on being heated. An advantage of using ink which is transferred as a vapour is that the vapour can pass across a small gap, so that good contact between ribbon and envelope is then not quite so critical.

In some instances, an energisable ribbon may be employed, locally energised by the thermal printing means.

In one embodiment the backing device may comprise a plurality of separate but axially touching discs or annuli of resiliently deformable material such as rubber or foamed plastics material such as foamed polyurethane, mounted as a unitary cylindrical member on a shaft, for rotation.

As an alternative to the employment of a differentially resiliently deformable backing device, the thermal printing means may itself be flexible, so as to be deformable along its length dimension to accommodate uneveness in the surface to be printed.

A flexible thermal printing means, of the aforesaid kind having an elongate conductive plate, may be used in conjunction with a rigid or a resiliently deformable backing roller.

DESCRIPTION OF EMBODIMENTS

Figure 1A:
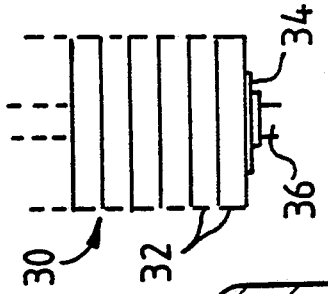
FIG. 1 is a cross section through a postal franking machine envelope guiding and printing head, embodying the invention, and FIG. 1A a detail of part thereof.
Figure 1:
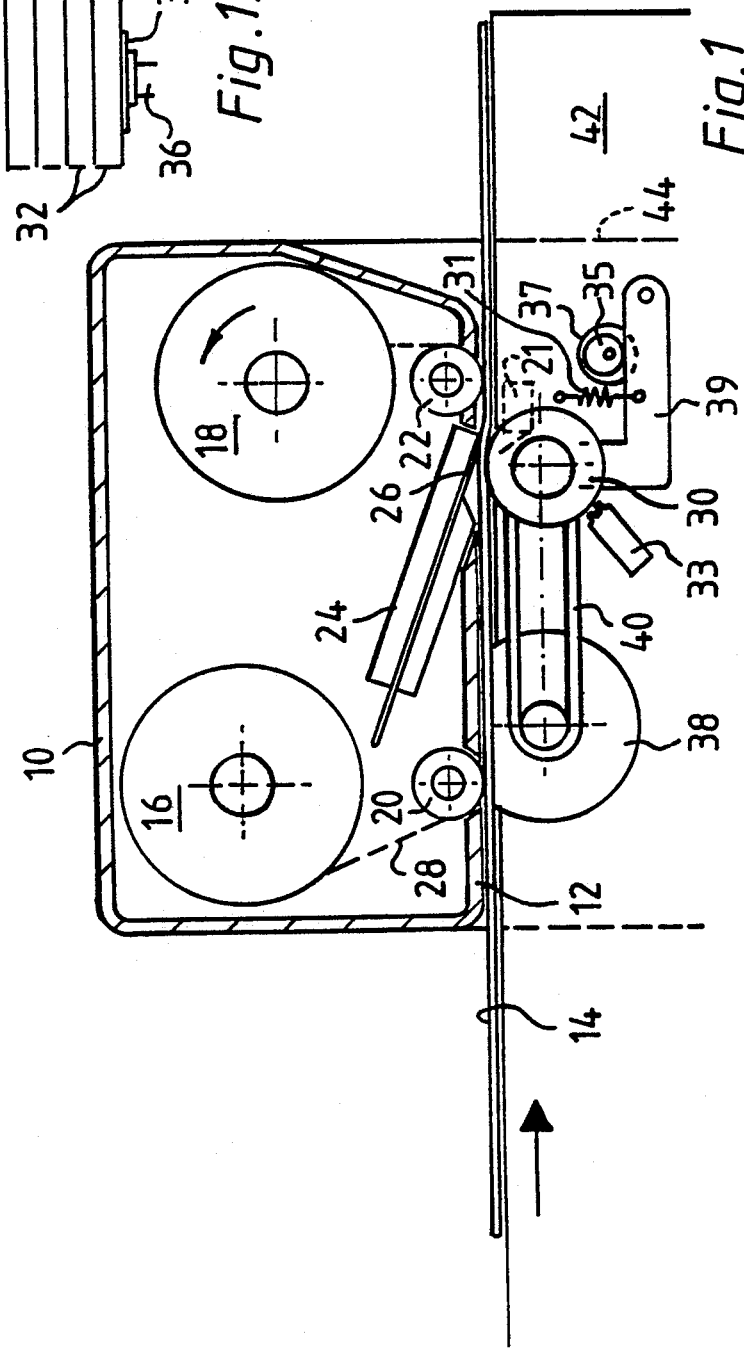
Figure 2:
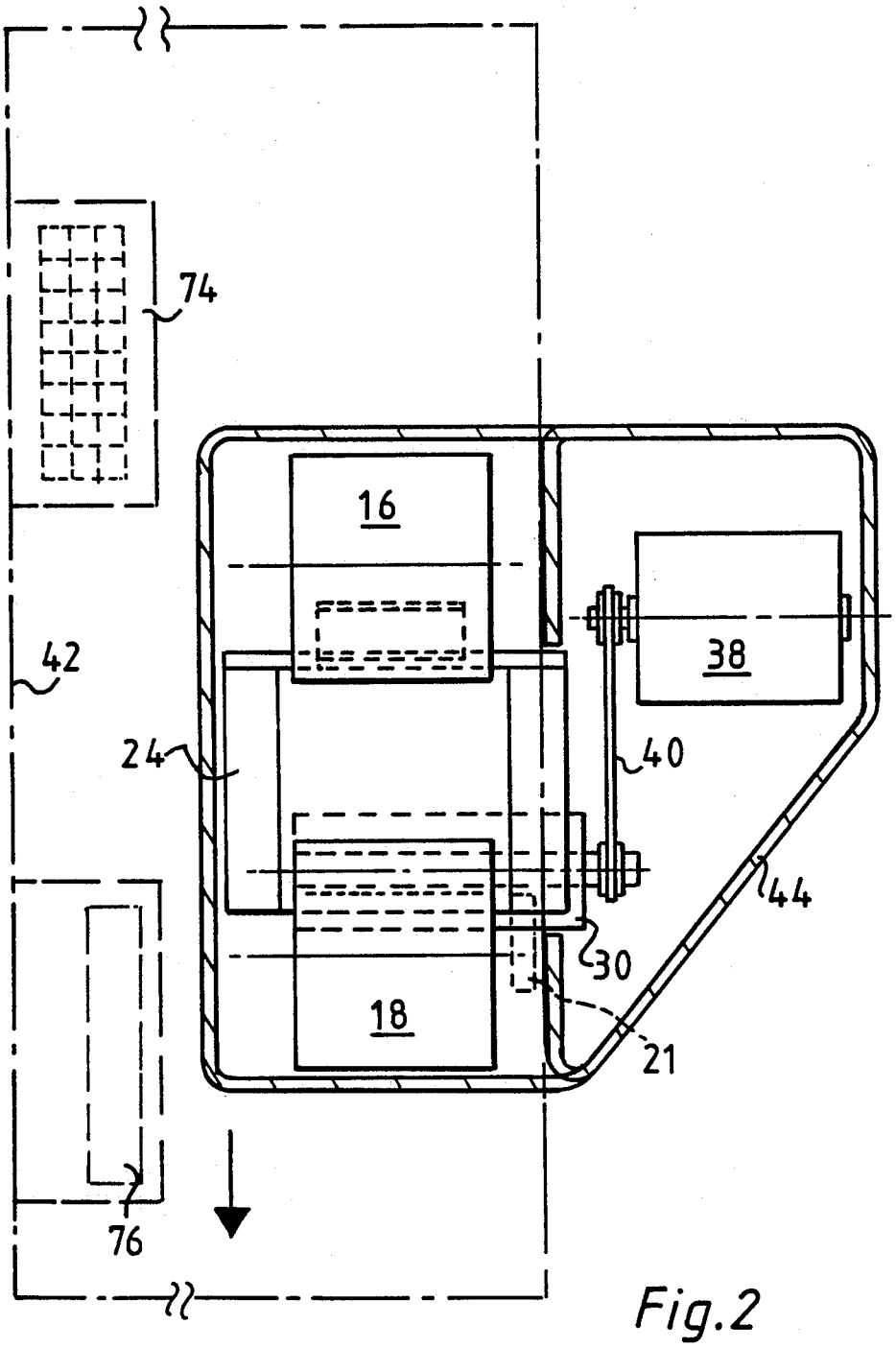
FIG. 2 is a plan view partly in cross section of the head shown in FIG. 1, shown in relation to the body of the franking machine.

FIGS. 1 and 2 show one embodiment of a franking machine embodying the invention comprising a housing 10 having a flat face 12 against which an envelope 14 slides as it is moved through the machine.

Within the housing 10 are mounted two spools 16, 18 the former spool having thermal transfer ribbon 28 wound thereon and the latter spool serving as a take-up spool.

One form of thermal transfer tape which may be used is that sold under the Trade name COPIAN as produced by Canon Inc. To this end the take-up spool 18 is driven by a slipping clutch drive from a motor (to be described) and the ribbon passes around two rollers 20 and 22 the former rotating as the envelope moves thereagainst.

The housing 10 is adapted to fit around a thermal print head 24 which includes associated electronic circuits which upon receipt of appropriate printing control signals from microprocessor control means (see FIG. 5) will produce localised heating of small regions along an elongate resistance element contained in the plate 26 which makes contact with the ribbon 28.

The print head is shown in more detail in FIGS. 6, 6A and 8 and will be described more fully in relation to these Figures. Its function is to produce localised heating along the length of the element to effect ink transfer in these regions to thereby effect franking of an envelope in contact therewith.

One such thermal print head is manufactured by Rohm Co. Ltd., Kyoto, Japan, under reference No. KH135, which as will be described later with reference to FIGS. 6–8, includes a shift register into which binary information can be introduced in a serial manner and which is then used to control the printing.

If a high printing speed is required the KH135 print head may be replaced by one having a shift register and a latch, to enable the shift register to be loaded whilst the binary information (transferred from it to the latch) is being used to print.

To ensure reliable deposition of ink onto the envelope the ribbon 28 is sandwiched between the plate 26 and the envelope 14, and the envelope is pressed against the ribbon under the action of a resiliently deformable roller 30.

In accordance with a preferred feature of the invention the roller 30 is formed from a plurality of annular discs 32 (see FIG. 1A) of foamed plastics material such as foamed polyurethane sandwiched between end plates of which one is shown at 34, mounted on a spindle 36. The spindle is grooved and formed with a pulley and is driven from a motor 38 by a belt drive 40(see FIG. 2).

The roller 30 and the plate 26 form a nip, and with rotation of roller 30 the envelope 14 is pulled through the nip. The forward passage of the envelope through the nip causes the impregnated ribbon to be drawn off the roller 16 and the combination of local heating of selected regions of the resistive element in the plate 26 and the pressure at the nip, causes ink from the ribbon to be deposited on the envelope at points corresponding to the points of localised heating along the length of the resistive element in the plate 26.

By feeding the appropriate control signals to the electrical control device associated with the current supply of the resistive element 26 and by synchronizing the arrival of these signals with the rotation of roller 30, so a required pattern of words and numerals can be formed on the envelope.

The characteristics of the impregnated ribbon 28 are such that ink is not transferred to the envelope except in regions of the plate 26 which are heated by electric currents associated with the print control signals (to be described in more detail with reference to FIGS. 6–8) and, it is a characteristic of the plate 26 that its thermal capacity is very small. In this way the heating effect of a local electric current produced by a print control signal (which may last for only a very short period of time) is limited to the short period of time for which the current lasts.

FIG. 2 shows the housing 10 in relation to the remainder of the machine, the base of which is shown in detail outline at 42. The region of the housing containing the spools 16, 18 overlies the base 42 and the roller 30 protrudes through a slot in the upper surface of the base 42 to form, with the printing head plate member 26, the nip through which the envelope passes as it is franked.

The roller 30 is spring loaded by spring means 31 in an upward direction, towards the plate 26. The upward spring loading is introduced after the envelope has been loaded, for which purpose a sensor 21 is provided (typically as shown in the form of a microswitch (see FIGS. 1 and 2)), to detect when the envelope is correctly positioned relative to the nip. Typically the roller 30 is formed with a track of alternate white and black regions which are detected by an optical sensor in the device 33 to generate pulses which can be decoded to determine the rotation of the roller and therefore the linear movement of the envelope in contact therewith. After a nip has been formed between the head 26 and roller 30 ribbon 28 will be drawn off spool 16.

The printing operation is controlled by a microprocessor 70 (see FIG. 5) and when the franking has been completed (as determined by the microprocessor) a signal is generated by the pressure to lower the resilient roller 30 by means of a cam 35 driven by motor 37 acting on arm 39 which supports the roller 30. Further withdrawal of tape from the spool is thus prevented whilst the envelope is withdrawn. The motor 37 is again activated when the leading edge of another envelope is sensed by the microswitch 21 thus to enable the spring loading to be reinstated and the printing process to begin again.

FIG. 2 shows how a section 44 of the housing 10 overhangs the base 42 and serves to house the motor 38 and drive belt 40. The relative positions of the rollers 20 and 22, spools 16 and 18, printing head 24 and microswitch 21 can be adjudged from a study of FIG. 2.

The print control signals which cause an appropriate pattern of words and numerals to be printed on the envelope by the printing head 24 are supplied from the microprocessor in accordance with the pulses from the sensor 33, obtained during rotation of the roller 30.

Figure 5:
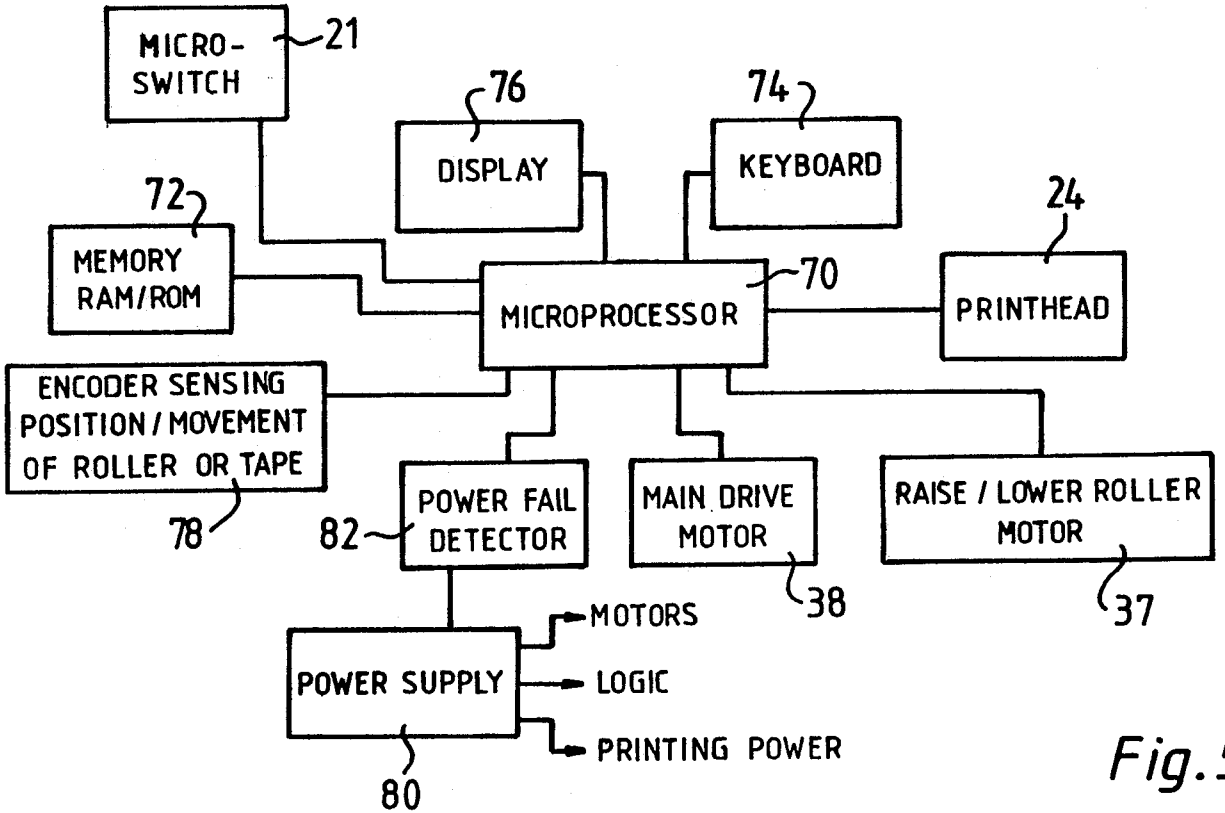
FIG. 5 is a circuit diagram.

The control system is shown in FIG. 5, wherein a microprocessor 70 associated with a RAM/ROM memory 72 supplies print control signals to the print head 24.

A keyboard 74 (see also FIG. 2), having an associated display 76 (again see also FIG. 2) enables any or all of the information to be printed (which information is stored in the RAM memory) to be changed at will.

The keyboard is also used for the selection of stored variable information which is to be applied to a particular envelope.

FIG. 5 also shows the microswitch 21 which initiates the process and an encoder 78 which embodies the sensor 33 and supplies signals to the microprocessor 70 to cause timing of the print control signals to be delivered correctly in relation to passage of the envelope.

A power supply 80 connects to the processor 70 via a power fail detector 82, and also supplies power to the print head the drive motor 38, the raise/lower motor 37, the logic circuitry embodied in the print head 24 and the resistive element which effects the local heating of the ribbon. The actual operation of the motors 37 and 38 is controlled by signals fed from the processor 70.

It is to be noted that the system enables all the print information to be changed if desired, or any chosen part thereof. Changed information is substituted in the memory 72 and is read by the processor 70 when a print program is initiated by actuation of the microswitch 21 by an envelope.

Figure 3:
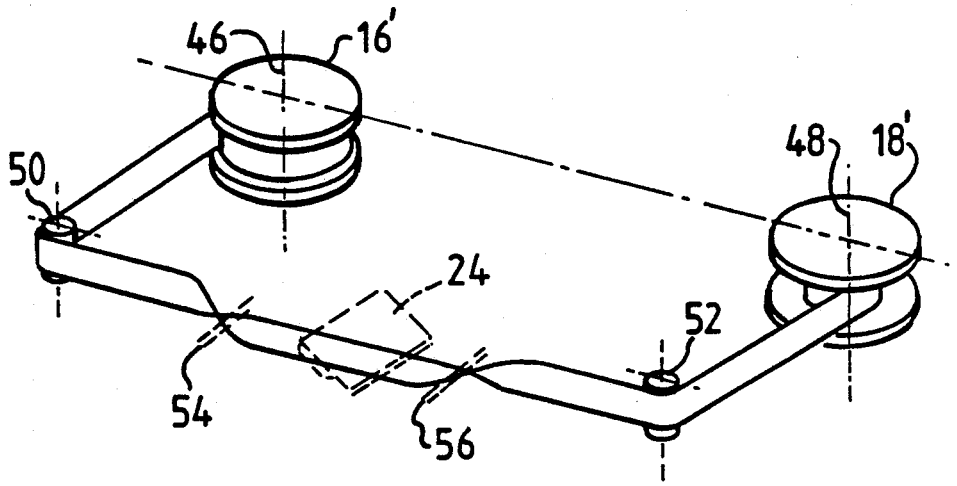
FIG. 3 is a diagrammatic view of an alternative spool arrangement.

In FIG. 3 an alternative spool arrangement is shown which if incorporated will allow the overall height of the housing 10 to be considerably reduced and will also allow larger spools to be utilised. In this arrangement the spools 16, 18 are replaced by spools 16', 18' which are mounted about axes of rotation 46, 48 which are perpendicular to the axes of rotation of the spools 16, 18. The height of the housing 10 is thus now dictated by the width of the tape 28 rather than the diameter of the spools 16, 18 and this will normally allow a lower profile to be obtained for the overall machine and will also allow larger diameter spools to be used.

The ribbon 28 must of course be presented to the envelope with the plane of the ribbon parallel to the envelope surface and to this end the ribbon path includes ribbon rollers 50, 52 and deflecting pins 54, 56 on either side of the printing head 24.

Figure 4:
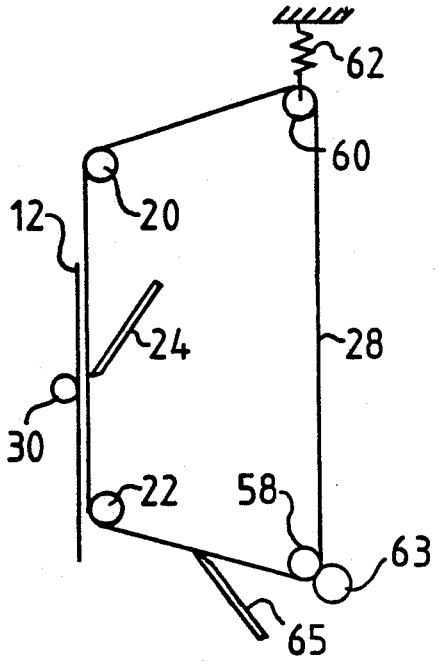
FIG. 4 is a diagrammatic view of a further alternative spool arrangement.

In the alternative arrangement shown in FIG. 4 the ribbon 28 is replaced by an endless belt of ribbon 28' which passes around rollers 20, 22 (corresponding to the rollers having the same numerical designation in FIG. 1) and around further rollers 58, 60. Roller 58 is driven by a slipping clutch drive (not shown) and forms, with an inking roller 63, a nip through which the ribbon 28' passes. The roller 63 is adapted to coat the ribbon with thermally transferable ink from a reservoir. The roller 63 may constitute the reservoir, e.g. being in the form of a porous ink loaded roller. Reference 65 denotes a device for removing surplus ink from the ribbon.

The roller 60 is acted on by spring means 62 to tension the endless belt 28'.

The printing station follows the same pattern as that shown in FIG. 1 and includes a resiliently deformable roller 30 movable into engagement with an envelope 12 to form with the printing head 24 a nip at which ink from the ribbon 28' will be transferred to the envelope.

Figure 6:
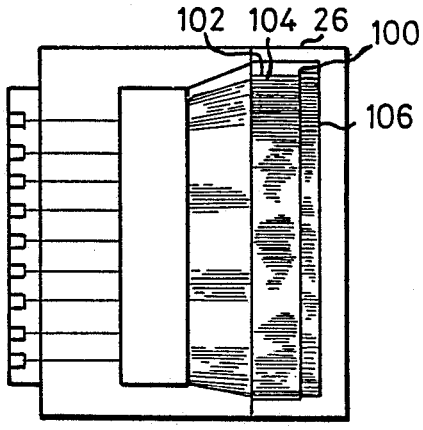
FIG. 6 is a plan view of a printing head.
Figure 6A:
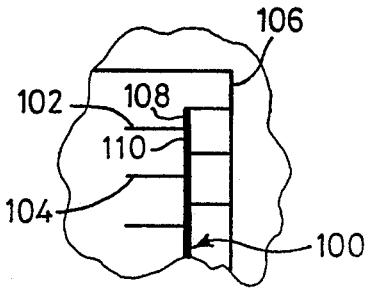
FIG. 6*a* shows an enlarged view of a portion of the printing head of FIG. 6.
Figure 7:
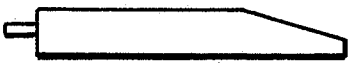
FIG. 7 is an end view of the head shown in FIG. 6.
Figure 8:
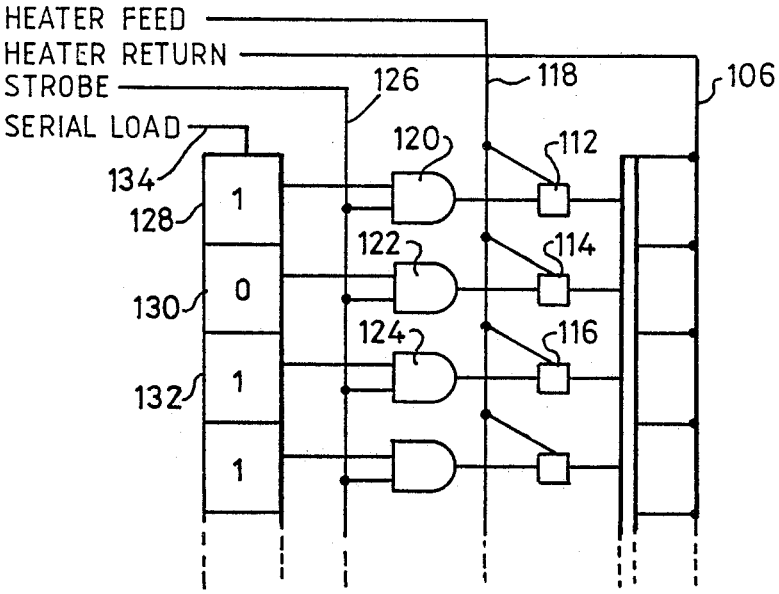
FIG. 8 is a logic diagram showing how different regions of the resistance element can be selected.

Turning now to FIGS. 6 to 8 these Figures illustrate the detail of the design and construction of the thermal print head as employed in this device. The head comprises a plate 26 of thermally and electrically insulating material having formed on the surface thereof a resistive track 100 to which connections are made via tracks 102, 104 etc., on one side, and via a track 106 on the other side. The track 106 is a common return path for the heating currents which are caused to flow through selected ones of the tracks 102, 104 etc.. As best seen in FIG. 6A, currents along 102 will pass through the two resistive track sections 108, 110, which are effectively in parallel, and will return to a current source via track 106, causing the regions 108, 110 to heat up. Typically there are 4, (preferably 8 or more) tracks such as 102, 104 etc., per millimeter run of the track 100, so that the area which is actually heated by any one current is very small and can be thought of as a small point.

Current flow along the tracks 102, 104 etc., is controlled by transistor devices shown in FIG. 8 at 112, 114, 116 etc., and a common supply to the transistors is shown at 118. A current source is connected between 118 and 106 so that when any or all of the transistors are turned ON currents will flow in the respective regions of the track 100 controlled thereby.

The switched condition of the transistors 112, 114 etc., is governed by logic gates 120, 122, 124 etc., which include two inputs both of which must be satisfied if the associated transistor is to be turned ON. To this end a strobe signal is applied to one of the inputs of all of the gates 120, 122 etc., via signal paths 126. The other inputs of the gates 120, 122 etc., are controlled by the switched condition of associated bistables 128, 130, 132 etc., which make up a shift register. The shift input of the latter is not shown but a load input is, at 134. In known manner a binary digital signal can be stored in the shift register via the serial input 134.

The line 100 can be thought of as being made up of a plurality of adjoining resistive segments and if a line is to be printed transversely to the direction of movement of the envelope, current must be supplied to all of the segments. This is achieved by loading a 1- into each of the shift register bistables associated therewith.

Letters and numerals can be formed in known manner by loading appropriate −0, −1 patterns into the shift register 128, 130 etc., and thereby controlling the currents flowing in the line of resistive elements 100, in a succession of steps, synchronously with the movement of the envelope and relative to the line 100. Each pattern of 0's and 1's correspond to one line scan of a letter or numeral taken transversely to the direction of movement of the envelope and, where for example dark regions of the letter or numeral corresponds to the 1's and the lighter surround (or background) corresponds to the 0's.

The end view of FIG. 7 demonstrates how the complete print head is accommodated in a very shallow package so that it can be easily fitted into a printer.

If as is shown in FIG. 8 buffer transisters are incorporated between gates 120 etc., and the resistive elements 100, the gates shown as AND gates may be replaced by NAND gates.

Printing Process

Ink is contained on the lower surface of the ribbon in contact with the envelope. Print head/resistance line 100 is above the ribbon in contact with the "smooth" non-inked surface of the ribbon.

The ribbon base is typically polyester film.

By squeezing the head, ribbon and envelope into contact using a pressure roller, the heating of the head causes the ink to melt and transfer to the envelope. Since the head is only heated in local spots as required, ink is only transferred in the region of these spots. Characters etc., can be formed, as described above.

By incrementing the envelope relative to the head (or vice versa) different "columns" of paper are presented to the heated "line" so enabling areas to be printed.

The amount of movement is determined by monitoring the movement of the ribbon. Because there is a slight stickiness between the ribbon and the envelope, the ribbon travels through the printing head in synchronism with the envelope.

I claim:

1. as follows: Postal franking apparatus for franking envelopes and the like of non-uniform thickness comprising:

(a) memory means for storing fixed and variable information to be printed onto an envelope;

(b) means for inputting information to said memory means to change some or all of the information stored therein;

(c) means for reading out information from said memory means to form printing control signals;

(d) a printing station through which an envelope to be franked can be transported;

(e) thermal printing means which includes a source of ink carried by a ribbon means and applied to the thermal printing means; and (f) means for supplying the printing control signals to said thermal printing means; wherein (g) a rotatable backing device confronting said thermal printing means to form together therewith a driving nip between which an envelope passes during printing, said backing device being a driven backing roller engaging said envelope and having a resilient deformability in a direction perpendicular to the surface of said envelope, said deformability varying differentially at discrete intervals along a line perpendicular to the direction of transport of the envelope; wherein (h) both the fixed and variable information being printed by thermal printing means which comprises a flexible, resilient plate of thermally and electrically insulating material fixedly mounted at said printing station, said plate being elongate in a direction transverse to the direction of transport of the envelope through said printing station and bearing a continuous elongated longitudinal conductive track to which a large plurality of electrical connections are made along the length thereof, and said supplying means comprises means for supplying electrical currents to a selected combination of discrete positions along the track corresponding to selected ones of the connections, the combination of current-supplied positions varying in predetermined relationshp to the transport of the envelope, the track being of a high resistivity such that the current-supplied positions along the track and hence the ink are locally heated and ink which is contiguous with the elongated conductive track is deposited onto the envelope only at a said heated localities, thereby to frank the envelope with both fixed and variable information.

2. A postal franking apparatus according to claim 1 wherein the printing means acts to heat an ink-bearing ribbon wherein the ink is adapted to melt to change its phase from a solid into a vapour phase on being heated.

3. Postal franking apparatus according to claim 1, wherein a re-usable endless loop of ribbon material is employed, and means is provided for removing surplus ink from the ribbon after passing the station printing and before the relevant region of ribbon is returned to an ink loading means.

4. Postal franking apparatus according to claim 1, wherein the printing means acts to heat an ink-bearing ribbon wherein the ink is adapted to melt and form a liquid on being heated.

5. Postal franking apparatus according to claim 1, wherein the thermal printing means acts to effect activation of an inked activible ribbon in order to effect franking.

6. Postal franking apparatus according to claim 1, wherein the thermal printing element is flexible, so as to be deformable along its length dimension to accommodate uneveness in the surface to be printed.

7. A postal franking apparatus according to claim 1 wherein the printing means acts to heat an ink-bearing ribbon wherein the ink is adapted to melt to change its phase from a liquid into a vapour phase on being heated.

8. Postal franking apparatus according to claim 1, wherein the backing device comprises a plurality of separate but axially touching discs or annuli of resiliently deformable material mounted as a unitary cylindrical member on a shaft, for rotation.

9. Postal franking apparatus according to claim 1, wherein the information inputting means includes a keyboard also usable to select from the stored information that variable information which is to be printed on a particular envelope.

* * * * *

UNITED STATES PATENT AND TRADEMARK OFFICE

CERTIFICATE OF CORRECTION

PATENT NO. : 4,746,234

DATED : May 24, 1988

INVENTOR(S) : Alan Harry

It is certified that error appears in the above-identified patent and that said Letters Patent is hereby corrected as shown below:

Column 1, line 6, change "July 6, 1984" to --July 16, 1984--.

Column 7, line 27, after "1" delete "as follows:".

Column 8, line 27, change "the station printing and" to --the printing station and--.

Signed and Sealed this

Twenty-second Day of May, 1990

*Attest:*

HARRY F. MANBECK, JR.

*Attesting Officer*

*Commissioner of Patents and Trademarks*